US006540005B1

(12) United States Patent
Daussan et al.

(10) Patent No.: US 6,540,005 B1
(45) Date of Patent: Apr. 1, 2003

(54) METHOD FOR PREPARING A CASTING MOULD

(75) Inventors: Jean Daussan, Metz (FR); Gérard Daussan, Longeville les Metz (FR); André Daussan, Nyon (CH)

(73) Assignee: Daussan & Compagnie (FR)

( * ) Notice: Subject to any disclaimer, the term of this patent is extended or adjusted under 35 U.S.C. 154(b) by 0 days.

(21) Appl. No.: 09/720,298

(22) PCT Filed: Jun. 3, 1999

(86) PCT No.: PCT/FR99/01307

§ 371 (c)(1),
(2), (4) Date: Feb. 9, 2001

(87) PCT Pub. No.: WO99/67045

PCT Pub. Date: Dec. 29, 1999

(30) Foreign Application Priority Data

Jun. 25, 1998 (FR) ..... 98 08088

(51) Int. Cl.[7] ..... B22D 27/00; B22D 33/04
(52) U.S. Cl. ..... 164/58.1; 164/134; 164/137
(58) Field of Search ..... 164/134, 137, 164/335, 358, 55.1, 56.1, 57.1, 58.1, 59.1, 339, 340

(56) References Cited

FOREIGN PATENT DOCUMENTS

| | | |
|---|---|---|
| DE | 87 11 468 | 10/1987 |
| EP | 578 517 | 1/1994 |
| JP | 63-43740 | * 2/1988 |
| JP | 63-043740 | 2/1988 |
| JP | 01-266942 | 10/1989 |

OTHER PUBLICATIONS

"Modern Casting", Title: Filtration of Irons with Cellular Ceramic Filters, By: Dr. Paul Day et al., Apr., 1984, pp. 16–18.

* cited by examiner

*Primary Examiner*—Kuang Y. Lin
(74) *Attorney, Agent, or Firm*—Bachman & LaPointe, P.C.

(57) ABSTRACT

A recess (2) forming a pouring gate (2) is provided in a first half (1*a*) of the mold (1) so as to open out in the parting face (4) in a housing (5) having a top opening (6) in its top portion. A second recess (8) is provided in the second half (1*b*) of the mold (1) with an opening (9) in the parting face (4) of dimensions smaller than the corresponding dimensions of the housing. The two mold halves (1*a*, 1*b*) are assembled together on the parting face (4) and a filter (12) adapted to filter molten metal is inserted into the housing (5) substantially vertically through the top opening (6) thereof.

13 Claims, 4 Drawing Sheets

METHOD FOR PREPARING A CASTING MOULD

The present invention relates to a method of preparing a casting mold comprising at least one mold cavity adapted to receive molten metal directed to said cavity by at least one pouring gate opening out into a runner extending downstream from the pouring gate to said cavity, the method being implemented in an automatic casting machine and including a step of preparing two mold halves and a step of assembling the two mold halves on a substantially vertical parting face.

Automatic machines for casting molten metal are known, e.g. machines available on the market under the trademark "DISAMATIC"®.

In such a machine, molds are placed on a closed circuit conveyor whereby the molds pass successively through stations for preparing the two mold halves, for assembling the two halves on a substantially vertical parting face, for casting molten metal into the mold made up in this way, for solidifying the cast metal inside the mold, and for disassembling the mold to release the casting(s).

Numerous tests have been performed attempting to interpose a filter on the passage of the molten metal so as to filter the molten metal before it reaches the mold cavity.

When molding hollow pieces, it is necessary to install at least one core in the mold cavity. The operation of installing the core is relatively lengthy and difficult. It is easy at the same time to install a filter on the path of the molten metal in the runner which is generally disposed astride the two mold halves.

In contrast, when no core is necessary, the operations of preparing the two mold halves are very quick, so all attempts at installing a filter have given negative results, with the placing of a filter giving rise to more drawbacks in terms of disturbing the operating cycle of the automatic casting machine than advantages in terms of improving the internal structure of the cast metal. In other words, industry prefers to favor the productivity of the automatic casting machine over a significant percentage of pieces that are rejected for faults concerning metal quality.

There thus exists a need for a method of the above type enabling a filter to be inserted on the path of the cast metal with practically no reduction in the productivity of an automatic machine for casting molten metal.

According to the present invention, the method of the above-specified type is characterized in that it comprises the following steps:

- providing a recess in a first half of the mold to form a pouring gate extending to the parting face;
- providing a housing in the parting face, substantially parallel to said parting face and at the periphery of the recess, the top portion of the housing presenting a top opening, said housing having predetermined dimensions parallel to said parting face that are greater than those of said gate and having predetermined thickness in the direction perpendicular to said parting face;
- providing a second recess in the second half of the mold having an opening in the parting face of dimensions that are smaller than the corresponding dimensions of the housing, the top portion of said recess being closed and said recess communicating downstream with a runner;
- assembling together the two mold halves on the parting face; and
- inserting a filter into the housing substantially vertically through the top opening thereof, which filter has dimensions that are perceptibly smaller than the corresponding predetermined dimensions of the housing and is adapted to filter molten metal so that molten metal poured into the gate passes through said filter and is then channeled by the second recess towards the runner.

The housing provided in the first mold half is upwardly open and enables a filter to be inserted easily and reliably in the top opening of said housing. This housing is closed at its periphery by the edges defining the opening of the recess in the second mold half. When the molten metal comes into the gate, this molten metal presses the filter against the second mold half. The filter is thus pressed in substantially leak-proof manner against the edges of the opening of the second mold half, thereby obliging the molten metal to pass through the filter and be filtered prior to penetrating into the mold cavity. A passage is thus provided for the molten metal enabling a filter to be inserted across the passage without disturbing the operation of an automatic casting machine.

This insertion of the filter can be performed either during any mold waiting time, e.g. during the duration of several seconds required for casting the molten metal into a preceding mold, or else even while the mold is being moved.

The clearance between the walls of the recess and those of the filter is sufficient to eliminate any risk of the filter jamming while it is being inserted, and the vibration accompanying displacement can further facilitate such insertion of the filter.

Furthermore, the person skilled in the art has been dissuaded from putting a filter into place in a substantially vertical position without any means for preventing possible uplift of the filter under the effect of buoyancy pressure, given that the density of the filter is much less than that of the molten metal.

Experience has confirmed that from the beginning of molten metal being poured into the gate, the molten metal presses the filter against the edges of the second recess so that friction against said edges prevents any displacement of the filter.

In an advantageous version of the invention, the housing and the filter are given respective complementary outlines in cross-section on a plane parallel to the parting face, which outlines are shaped in such a manner as to center the filter automatically relative to the housing, e.g. outlines of trapezoidal shape with the small base downwards.

In a preferred embodiment, a filter is used comprising a series of at least two filter plates of refractory material defining a corresponding cavity between two adjacent plates, each of said plates having a series of filter holes allowing molten metal to pass through and be filtered, at least one of the cavities containing a molten metal treatment material in the form of a compressed, sintered, or molded slab, the slab of treatment material being of a shape such that when seen in the travel direction of the molten metal, it leaves at least one uncovered region having filter holes that are not obstructed by said slab in each of the filter plates so as to enable molten metal that has penetrated into the cavity to come into contact with the treatment material of the slab and flow around said slab and then through the filter holes of the second filter plate.

Such a filter is known, in particular form EP-A-0 578 517 and FR 98/01634 in the name of the Applicant.

The cavity provided between the two plates fills with molten metal substantially at the same time as the gate, thus weighing down the filter. This weighing down of the filter, combined with the fact that the molten metal present in the gate presses the filter against the edges of the second recess, ensures that there is no risk of the filter rising under the effect of buoyancy pressure.

In addition, the molten metal is not only filtered but is also treated under excellent conditions of reliability and uniformity of treatment.

In another aspect of the invention, a mold for casting molten metal of the present invention, comprises at least one mold cavity adapted to receive molten metal directed to said cavity by at least one pouring gate opening out into a runner extending downstream from the pouring gate to said cavity with a filter being interposed on the path of the molten metal, and is characterized in that said mold is prepared by implementing the method of the first aspect of the invention.

Other features and advantages of the present invention appear in the following detailed description.

In the accompanying drawings, given purely as non-limiting examples:

Figure 1:
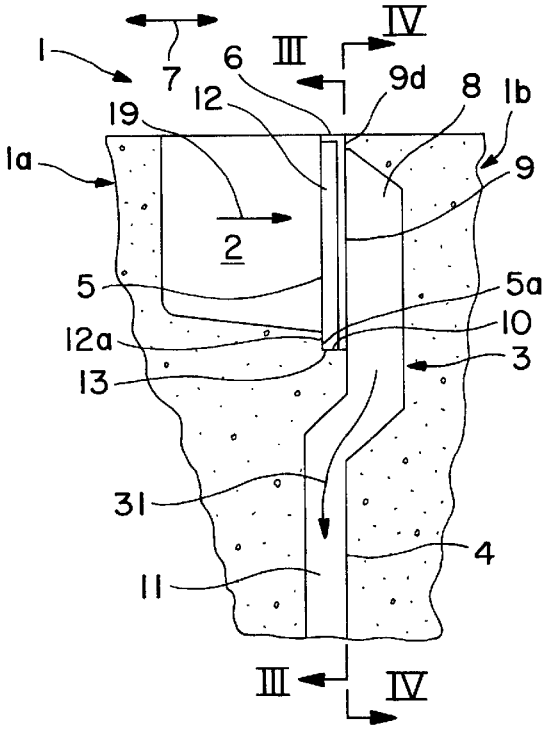
FIG. 1 is a fragmentary section view on a plane perpendicular to the parting face through a casting mold constituting an embodiment of the present invention.

Diagrammatic FIGS. 1 to 4 show a casting mold 1 having at least one mold cavity 60 (see FIG. 11) adapted to receive molten metal which is directed to said cavity 60 via at least one pouring gate 2 opening out into a runner 3 extending downstream from the pouring gate 2 to said casting cavity 60.

Such a mold 1 is suitable for being prepared by a closed circuit automatic casting machine, e.g. a machine of the "DISAMATIC"® type, and it is made up of two mold halves 1*a* and 1*b* which are assembled one against the other on a substantially vertical parting face 4.

In accordance with the invention, the method of preparing a casting mold 1 is characterized in that it comprises the following steps:

providing a recess 2 in a first half 1*a* of the mold 1 to form a pouring gate 2 extending to the parting face 4;

providing a housing 5 in the parting face 4 substantially parallel to said parting face 4 and at the periphery of the recess 2, the top portion of the housing presenting a top opening 6, said housing 5 having predetermined dimensions parallel to said parting face 4 that are greater than those of said gate 2 and having predetermined thickness in the direction 7 perpendicular to said parting face 4;

providing a second recess 8 in the second half 1*b* of the mold 1 having an opening 9 in the parting face 4 of dimensions that are smaller than the corresponding dimensions of the housing 5, the top portion of said recess 8 being closed and said recess communicating downstream with a runner 3;

assembling together the two mold halves 1*a*, 1*b* on the parting face 4; and inserting a filter 12 into the housing 5 substantially vertically through the top opening 6 thereof, which filter has dimensions that are perceptibly smaller than the corresponding predetermined dimensions of the housing 5 and is adapted to filter molten metal so that molten metal poured into the gate 2 passes through said filter 12 and is then channeled by the second recess 8 towards the runner 3.

The filter 12 is any known filter, e.g. a filter of refractory material (ceramic) pieced by holes for passing molten metal.

The dimensions of the housing and the dimensions of the filter are predetermined so as to take account of manufacturing tolerances and of the clearances necessary for ensuring that the filter 12 can be inserted easily and reliably into the housing 5.

The gate 2 is preferably defined so as to direct the molten metal over the entire width and substantially the entire height of the filtering zone of the filter, e.g. the zone pierced by holes for passing molten metal.

In the example shown in FIGS. 1 to 4, the second recess 8 on its own constitutes a first segment of the runner 3 and extends substantially vertically downwards beyond the bottom seat 10 of the housing 5. It opens out into a second segment 11 of the runner which is arranged at least in part in the first half 1*a* of the mold 1, and which is adapted to direct the molten metal to the molding cavity 60 of the mold 1.

The second segment 11 could equally well extend horizontally on one side or on both sides of the second housing 8, or it could follow any path or direction to said cavity.

The second segment 11 of the runner 3 can naturally be provided astride the two halves 1*a* and 1*b* of the mold 1 on either side of the parting face 4.

To facilitate insertion and positioning of the filter 12 in the housing 5, the housing 5 and the filter 12 are given respective complementary outlines in cross-section on a plane parallel to the parting face 4 that are shaped in such a manner as to center the filter 12 automatically to the housing 5.

Figure 3:
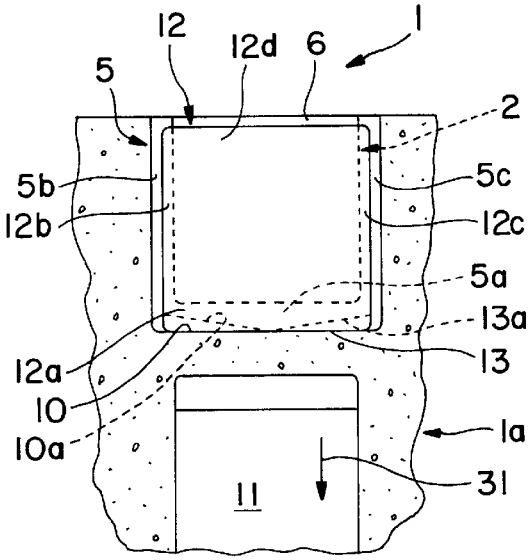
FIG. 3 is a fragmentary section view on III—III of FIG. 1.
Figure 2:
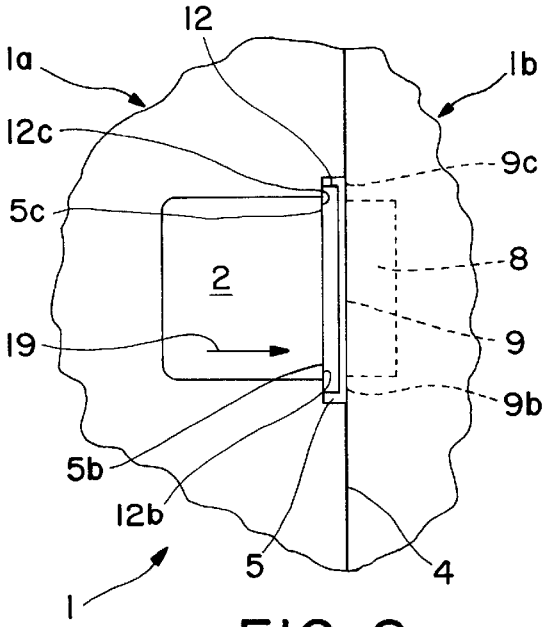
FIG. 2 is a plan view of the FIG. 1 mold.

As shown diagrammatically in FIG. 3, the filter 12 is given an outline in cross-section on a plane parallel to the parting face 4 that is in the form of a regular trapezoid with its small base downwards. This substantially trapezoidal shape can be restricted to the bottom portion of the housing 5 and of the filter 12.

The same can be true of the housing 5.

In addition, or in a variant, it is possible to give the housing 5 and the filter 12 respective complementary outlines in cross-section on a plane parallel to the parting face 4 providing respective bottom surfaces 10 and 13 forming a concave seat.

Such a concave seat can be rounded in shape or in the form of a reentrant dihedral as shown diagrammatically at 13*a* in FIG. 3.

The essential condition to be complied with is that the filter must take up its position automatically inside the housing 5 with sufficient accuracy to ensure that when pressed against the peripheral edges of the opening 9 of the second recess 8 the filter 12 has its peripheral outline covering all of the edges of the opening 9 so as to ensure that all of the molten metal poured into gate 2 must pass through the filter 12 in order to be directed subsequently to the molding cavity by the first segment 8 and by the second segment 11 of the runner 3, as represented by arrow 31 in FIG. 1.

The respective outlines of the housing 5 and of the filter 12 are shown in continuous lines in FIG. 3, while dashed lines show the outline of the gate 2 level with the housing 5. This shows up the bottom edges 5*a*, 12*a*, the side edges 5*b*, 5*c* ; 12*b*, 12*c*, and the top edge 12*d* respectively of the housing 5 and of the filter 12 on their faces that are parallel to the parting face 4.

Figure 4:
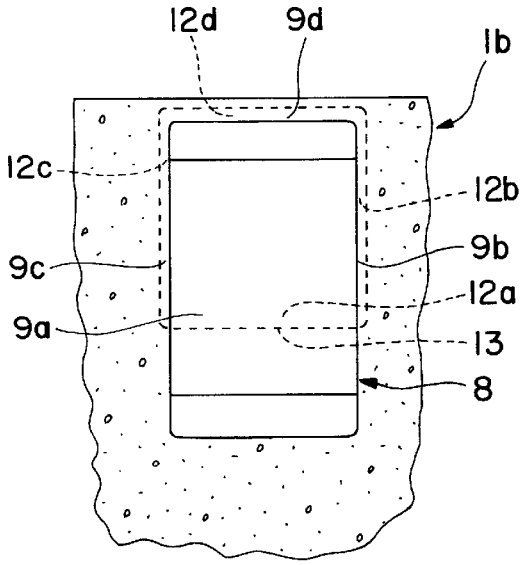
FIG. 4 is a fragmentary section view on IV—IV of FIG. 1.

Similarly, the outline of the opening 9 of the second recess 8 is shown in continuous lines in FIG. 4 and dashed lines show the corresponding position of the outline of the filter 12. This thus shows the bottom edge 9*a*, the side edges 9*b*, 9*c* and the top edge 9*d* of the opening 9, together with the bottom edge 12*a*, the side edges 12*b*, 12*c*, and the top edge 12*d* of the filter 12 on their respective faces parallel to the parting face 4.

It can be seen that, while the filter 12 is being inserted into the housing 5 via the top opening 6, it has its side edges 12*b*, 12*c* guided on one side by the corresponding edge 5*d*, 5*c* of the housing 5 and on the other side by the corresponding edge 9*b*, 9*c* of the second recess 9.

While the molten metal is being cast, the edges 12*b*, 12*c*, and 12*d* of the filter are pressed against the corresponding edges 9*b*, 9*c*, and 9*d* of the opening 9 of the second recess 8, while its seat 13 rests over its entire length of the seat 10 of the housing 5 so as to ensure that all of the molten metal passes through the filter 12.

Figure 5:
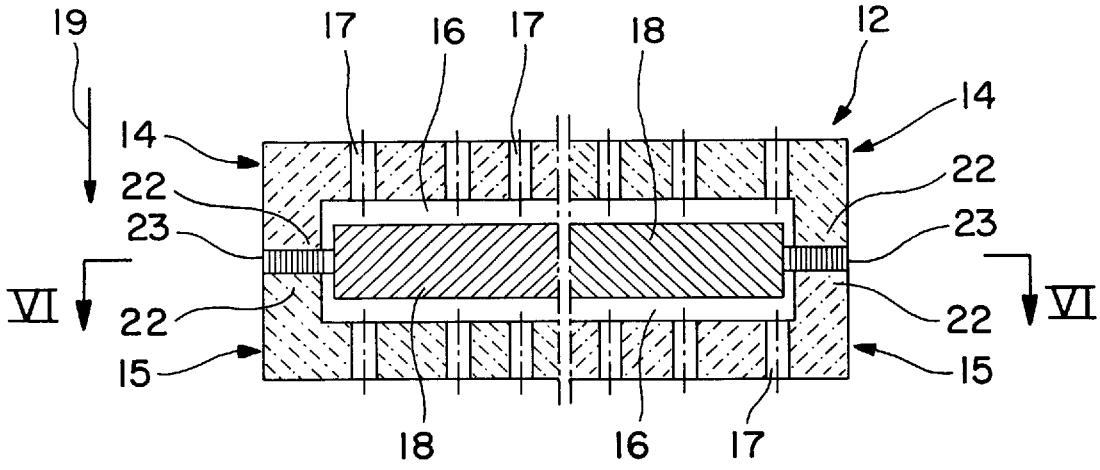
FIG. 5 is a section view on V—V of FIG. 6 through an embodiment of a filter suitable for use in the mold of FIGS. 1 to 6.
Figure 6:
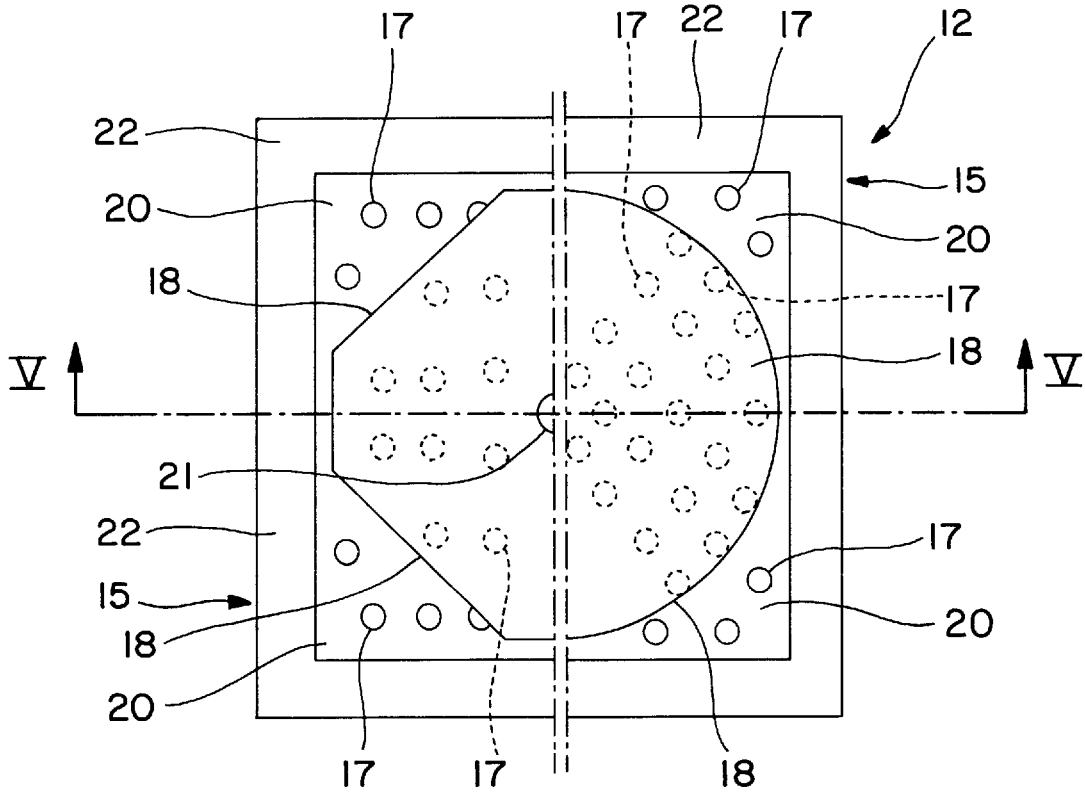
FIG. 6 is a section view on VI—VI of FIG. 5 through the filter shown in said FIG. 5.

In the example shown diagrammatically in FIGS. 5 and 6, a filter 12 is used that comprises a series of at least two filter plates 14 and 15 of refractory material defining a corresponding cavity 16 between the two adjacent plates 14 and 15. Each of these filter plates 14 and 15 has a series of filter holes 17 allowing molten metal to pass through and being filtered, at least one of the cavities 16 containing a material for treating molten metal. By way of example, the plates 14 and 15 are kiln-fired ceramic plates, in particular plates filed at about 1400° C., if the metal to be treated is cast iron or steel.

It is preferable to use a treatment material in the form of a slab 18 that is compressed, sintered, or molded, the slab 18 of treatment material being of a shape such that seen in the travel direction 19 of the molten metal, it leaves in each filter plate 14, 15 at least one region 20 that is uncovered and that includes filter holes 17 that are not obstructed by said slab 18 so as to allow the molten metal which has penetrated into the cavity 16 by passing through the first filter plate 14 to come into contact with the treatment material of the slab 18 and to flow around said slab 18 and then through the filter holes 17 of the second filter plate 15.

It is common practice to select the treatment material from: desulfurizing agents, heat generating agents, innoculating agents, spheroidizing agents, vermiculating agents, carbon correcting agents, decarburizing agents, modifying agents, and alloy additives.

In conventional manner, the weight of treatment material used lies in the range about 0.001% to about 2% of the weight of molten metal to be treated.

The dimensions of the slab 18 parallel to the parting face 4, and the thickness of said slab are selected in such a manner that the treatment material is completely or substantially completely absorbed by the liquid metal while the molten metal is being cast, said absorption taking place in substantially regular manner throughout the duration of said casting.

By way of non-limiting examples, FIGS. 5 and 6 show in the left-hand half of each of these two figures a slab of substantially octagonal section leaving an uncovered region 20 in each of the four corners of the cavity 16, said region having uncovered filter holes 17 which are drawn in continuous lines in FIG. 6.

This octagonal slab can have a central hole 21 of any diameter.

In the right-hand halves of FIGS. 5 and 6, a slab is shown of substantially circular section likewise leaving uncovered regions 20 in each of the four corners of the cavity 16.

The circular section slab can also have a hole (not shown) of any diameter, e.g. in its center.

To clarity FIGS. 5 and 6, only a fraction of the filter holes 17 have been shown, the holes advantageously have a diameter lying in the range 1.5 mm to 4 mm, preferably lying in the range 2 mm to 3 mm, being about 2.5 mm. Naturally, the number of holes 17 is determined so that the holes 17 together make up a total section for passing molten metal that is compatible with casting requirements.

In the example shown in the figures, each of the filter plates 14, 15 has a peripheral rim 22 on one of its faces, and the two plates 14 and 15 are united along their respective peripheral rims 22 by means of a gasket 23 after the slab 18 has been inserted in the cavity.

In the embodiments shown in FIGS. 7 to 15, the hosing 5 and/or the mold 1 are provided with means for creating friction forces opposing the buoyancy thrust exerted by the molten metal on the filter 12 when said molten metal presses the filter 12 against the edges 9*a*, 9*b*, 9*c*, and 9*d* of the opening 9.

Figures 8A, 8B:
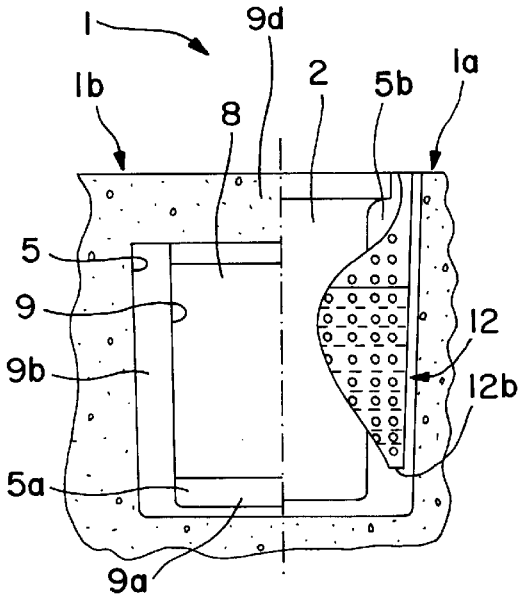
FIGS. 8A and 8B are juxtaposed half-views in section respectively on VIIIA—VIIIA and VIIIB—VIIIB of FIG. 7.
Figure 7:
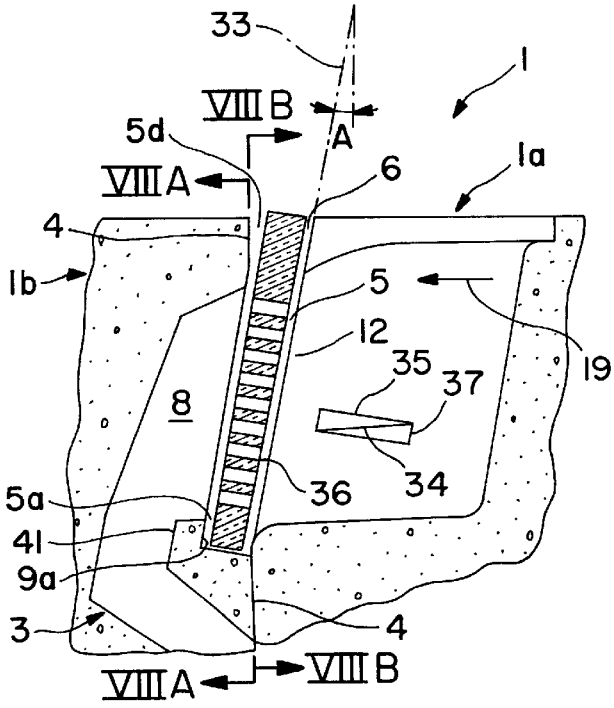
FIG. 7 is a view similar to FIG. 1 showing another embodiment of the present invention.

In the embodiment shown in FIGS. 7 and 8, the housing 5 extends substantially vertically on a plane 33 that slopes downwards and downstream in the flow direction 19 of the molten metal by a small predetermined angle A relative to the vertical plane.

In other words, the bottom end 5*a* of the housing 5 is further forwards in the direction 19 than is the top end 5*d* of said housing.

In the example shown, the housing 5 is provided, at least in its bottom portion, in the second half 1*b* of the mold 1.

In general, this housing 5 is provided in such a manner as to facilitate provision of the halves 1*a* and 1*b* of the mold 1 while enabling the edges of the filter 12 to press against the edges of the opening 9 under thrust from the molten metal poured into the gate 2.

By way of example, the angle A is about 70 to 80 relative to the vertical.

Thus, as shown diagrammatically in FIG. 7, the thrust 34 exerted by the molten metal against the inlet face 35 of the filter 12 in a substantially horizontal direction has a component 36 perpendicular to said inlet face 35 which presses the filter 12 against the edges of the opening 9, and a component 37 parallel to said inlet face that is directed downwards, pressing the filter 12 against the bottom seat 10.

In the example of FIG. 7, it can be seen that the opening 9 is defined at its bottom by a barrier 41 whose face directed towards the filter 12 forms the bottom edge 9*a* against which the bottom edge 12*a* of the filter 12 presses.

Figure 10:
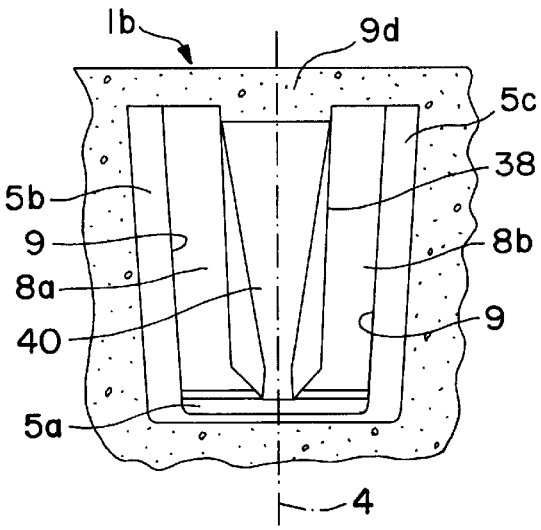
FIG. 10 is a section view on X—X of FIG. 9, the filter being omitted in order to clarify the figure.
Figure 9:
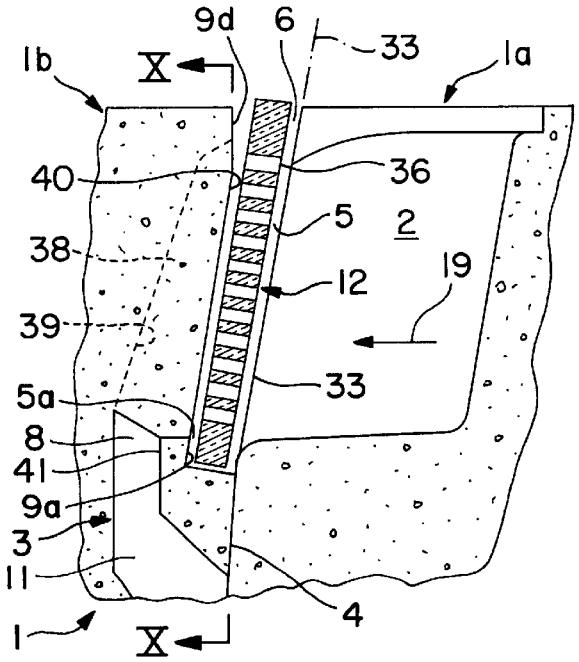
FIG. 9 is a view similar to FIG. 7 showing another embodiment of the invention.

In the embodiment of FIGS. 9 and 10, the second half 1*b* of the mold 1 has a central tongue 38 extending from the rear face 39 of the second recess 8 in the opposite direction to the metal travel direction 19, and it presents a front face 40 against which the filter 12 presses over the entire height or some fraction of the height of the recess 8.

The tongue 38 thus subdivides the second recess 8 into two portions 8*a*, 8*b* which can extend in any manner, either as a single runner 11 that is downwardly directed as shown diagrammatically in FIG. 9, or else as two separate runners (not shown) extending in any manner towards a single mold cavity or towards a plurality of distinct mold cavities.

The bearing face 40 of the tongue 38 lies in the plane containing the edges 9*a* to 9*d* of the opening 9 and constitutes not only a bearing surface, but also an additional friction surface between the filter 12 and the mold 1.

In the embodiment of FIGS. 11 to 14, a bulging portion 53, 54 is provided on at least one and in the present case on each of the substantially vertical longitudinal walls 51, 52 of the housing 5 so as to project into said housing 5 towards the other wall 52, 51 and thus create a slight narrowing suitable for guiding and centering the bottom portion of the filter 12 which passes through said narrowing when the filter 12 is inserted into the housing 5.

The respective upper faces 53*a*, 54*a* of the bulging portions 53, 54 make a smooth angle with the corresponding wall 51, 52 so as to co-operate with the necessarily rounded bottom corners 55, 56 of the filter 12 so as to provide progressive guidance and then progressive clamping of said filter as said filter penetrates more deeply into the cavity 5.

The corresponding clamping forces exerted by the bulging portions 53, 54 on the adjacent longitudinal walls 57, 58 of the filter 12 give rise to friction forces which oppose the buoyancy thrust exerted by the molten metal on the filter 12.

Naturally, the dimensions of the bulging portions 53, 54 can be varied at will as a function of the friction forces that are to be obtained.

Figure 15:
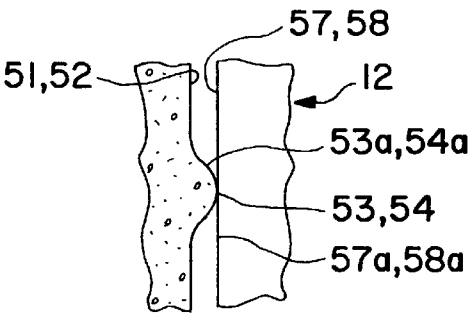
FIG. 15 is a diagrammatic view on a larger scale of a detail of FIG. 14.

It is also possible, if it is desired to avoid a reduction in said friction forces in the event of the filter 12 being displaced slightly upwardly if said filter 12 is trapezoidal in shape, to provide these bulging portions 53, 54 on vertical segments 57*a*, 58*a* of the walls 57, 58 of said filter 12, as shown diagrammatically in FIG. 15.

Figure 13:
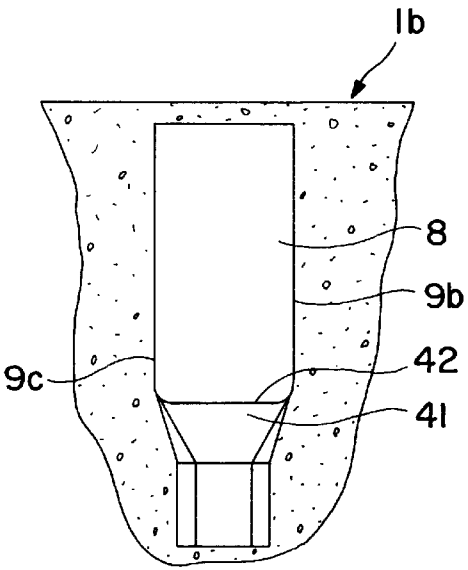
FIG. 13 is a fragmentary section view on XIII—XIII of FIG. 11.
Figure 11:
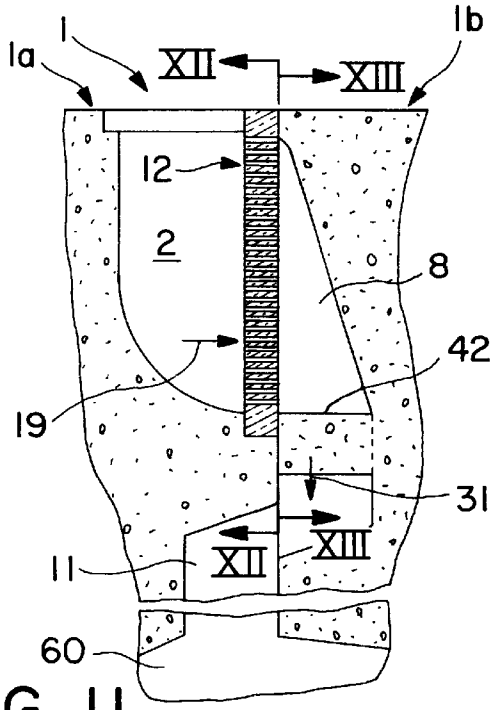
FIG. 11 is a view similar to FIG. 1 showing another embodiment of the present invention.
Figure 14:
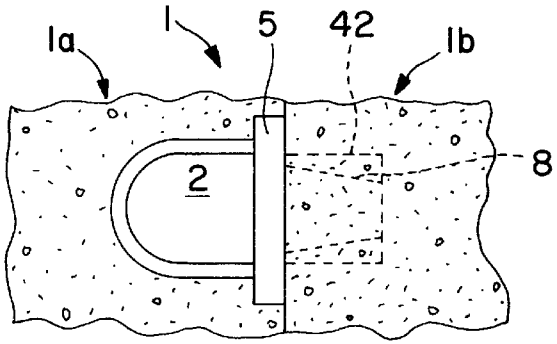
FIG. 14 is a plan view of the FIG. 11 embodiment.
Figure 12:
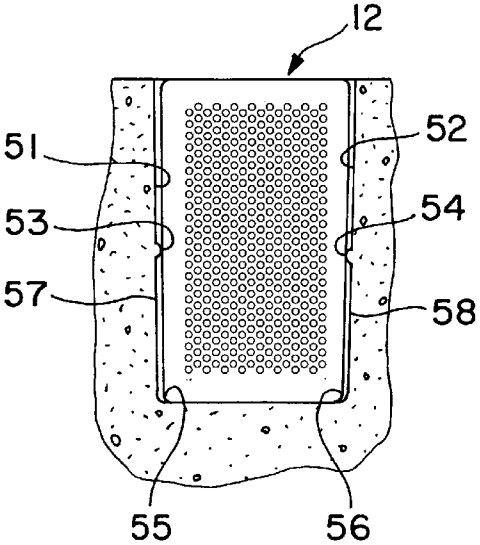
FIG. 12 is a fragmentary section view on XII—XII of FIG. 11.

In FIGS. 11, 13, and 14, it will be observed that the barrier 41 constituting the bottom edge 9*a* of the opening 9 against which the bottom edge 12*a* of the filter 12 presses is constituted, in this example, by a bridge 42 provided in the bottom portion of the recess 8 over all or part of the length occupied by the holes in the filter 12, and extending in the direction 19 to the bottom of the recess 8 which is split into two runners.

To simplify the figures, FIGS. 11 to 15 show bulging portions 53, 54 as applied to a vertical housing 5. Naturally, such bulging portions could be provided in a sloping housing of the type shown in FIGS. 7 to 10, and such bulging portions can be regularly associated with a barrier 41 and/or a tongue 38.

Naturally, the present invention is not limited to the embodiments described above, and numerous changes and modifications can be made thereto without going beyond the ambit of the invention.

The method described above is naturally equally applicable to molds with or without a core inside the mold.

What is claimed is:

1. A method of preparing a casting mold (1) comprising at least one mold cavity (60) adapted to receive molten metal directed to said cavity (60) via at least one pouring gate (2) opening out into a runner (3) extending downstream from the at least one pouring gate (2) to said at least one cavity (60), said method being implemented in an automatic casting machine and including a step of preparing two mold halves (1*a*, 1*b*) together on a substantially vertical parting face (4), the method being characterized in that it comprises the following steps:

providing a first recess (2) in a first half (1*a*) of the mold (1) to form a first pouring gate (2) extending to the parting face (4);

providing a housing (5) in the parting face (4) substantially parallel to said parting face (4) and at a periphery of the first recess (2), a top portion of the housing presenting a top opening (6), said housing (5) having predetermined dimensions parallel to said parting face (4) that are greater than those of said first pouring gate (2) and having predetermined thickness in a direction (7) perpendicular to said parting face (4);

providing a second recess (8) in a second half (1*b*) of the mold (1) having a second opening (9) in the parting face (4) of dimensions that are smaller than the corresponding dimensions of the housing (5), a top portion of said second recess (8) being closed and said second recess communicating downstream with a runner (3);

assembling together the two mold halves (1*a*, 1*b*) on the parting face (4); and inserting a filter (12) into the housing (5) substantially vertically through the top opening (6) thereof, which filter has dimensions that are perceptibly smaller than the corresponding predetermined dimensions of the housing (5) and which filter filters molten metal so that molten metal poured into the first pouring gate (2) passes through said filter (12) and is then channeled by the second recess (8) towards the runner (3), said inserting step being performed subsequent to said assembling step.

2. A method according to claim 1, characterized in that the housing (5) and the filter (12) are given respective complementary outlines in cross-section on a plane parallel to the parting face (4), which outlines are shaped in such a manner as to center the filter (12) automatically relative to the housing (5).

3. A method according to claim 1, characterized in that the filter (12) is given an outline in cross-section in a plane parallel to the parting face (4) that is trapezoidal in shape at least in its bottom portion, with the small base of said trapezoid downwards.

4. A method according to any preceding claim 1, characterized in that respective complementary outlines are given to the housing (5) and to the filter (12) in cross-section in a plane parallel to the parting face (4), which outlines include a concave bottom seat (10, 13).

5. A method according to claim 1, characterized in that at least one of the housing (5) and the second half of the mold (1) is provided with means for creating friction forces opposing the buoyancy thrust exerted by the molten metal on the filter when said molten metal presses the filter (12) against the edges (9*a*, 9*b*, 9*c*, 9*d* ) of the second opening (9).

6. A method according to claim 5, characterized in that the housing (5) extends in a plane that slopes downward and downstream of the molten metal flow direction at a predetermined angle relative to a vertical plane.

7. A method according to claim 5 characterized in that a bulging portion (53, 54) is provided on at least one longitudinal wall (51, 52) of the housing (5) to project into said housing (5) towards another of said longitudinal wall (52, 51) so as to create a slight narrowing adapted to guide the bottom portion of the filter (12) which passes through said narrowing when the filter (12) is inserted into the housing (5).

8. A method according to claim 5 characterized in that a central tongue (38) is provided in the second half (1b) of the mold (1) subdividing the second recess (8) into two portions (8*a*, 8*b*).

9. A method according to claim 1, characterized in that said filter (12) is used comprising comprises a series of at least two filter plates (14, 15) of refractory material which define a corresponding cavity (16) between two adjacent plates (14, 15), each of said plates (14, 15) having a series of filter holes (17) allowing molten metal to pass through and be filtered, and at least one of the cavities (16) containing a molten metal treatment material.

10. A method according to claim 9, characterized in that said molten metal treatment material is in the form of a compressed, sintered, or molded slab (18), the slab (18) of treatment material being of a shape such that when seen in the travel direction (19) of the molten metal, it leaves at least one uncovered region (20) having filter holes (17) that are not obstructed by said slab (18) in each of the filter plates (14, 15) so as to enable molten metal that has penetrated into the at least one cavity (16) to come into contact with the treatment material of the slab (18) and flow around said slab (18) and then through the filter holes (17) of the second filter plate (15).

11. A method according to claim 9, characterized in that the treatment material is selected from: desulfurizing agents, heat generating agents, innoculating agents, spheroidizing agents, vermiculating agents, carbon correcting agents, decarburizing agents, modifying agents, and alloy additives.

12. A method according to claim 9 characterized in that the treatment material has a weight which lies in the range of about 0.001% to about 2% of the weight of molten metal to be treated.

13. A method according to claim 1, characterized in that the housing is given an outline in cross-section in a plane parallel to the parting face (4) that is trapezoidal in shape at least in its bottom portion with the small base of said trapezoid downwards.

* * * * *